US005435440A

United States Patent [19]

Focke et al.

[11] Patent Number: 5,435,440

[45] Date of Patent: Jul. 25, 1995

[54] HINGE LID PACK, ESPECIALLY FOR CIGARETTES, WITH STRUCTURAL LOCKING DEVICE

[75] Inventors: Heinz Focke; Helmut Granz, both of Verden, Germany

[73] Assignee: Focke & Co., (GmbH & Co.), Verden, Germany

[21] Appl. No.: 629,882

[22] Filed: Dec. 19, 1990

[30] Foreign Application Priority Data

Dec. 20, 1989 [DE] Germany ..... 39 42 034.5

[51] Int. Cl.[6] ..... B65D 85/10

[52] U.S. Cl. ..... 206/271; 206/273; 206/265; 229/160.1

[58] Field of Search ..... 206/271, 273, 274, 265, 206/266; 229/160.1, 146, 148

[56] References Cited

U.S. PATENT DOCUMENTS

| | | | |
|---|---|---|---|
| 3,105,591 | 10/1963 | Ahlbor | 229/160.1 |
| 3,944,066 | 3/1976 | Niepmann | 206/268 |
| 4,526,317 | 7/1985 | Cassidy | 229/44 CB |
| 4,753,383 | 6/1988 | Focke et al. | 229/160.1 |
| 4,948,038 | 8/1990 | Moeller | 229/146 |

FOREIGN PATENT DOCUMENTS

| | | | |
|---|---|---|---|
| 0205766 | 12/1986 | European Pat. Off. . | |
| 2294920 | 7/1976 | France | 229/160.1 |
| 2639917 | 6/1990 | France | 229/160.1 |
| 1057436 | 5/1959 | Germany . | |
| 1142545 | 1/1963 | Germany . | |
| 1161513 | 1/1964 | Germany . | |
| 2641933 | 3/1977 | Germany . | |
| 2940944 | 5/1980 | Germany . | |
| 3037109 | 4/1981 | Germany . | |
| 3624345A1 | 1/1988 | Germany . | |
| 3819874 | 1/1989 | Germany . | |
| 3624345C2 | 11/1989 | Germany . | |
| 867404 | 5/1961 | United Kingdom | 229/160.1 |

*Primary Examiner*—Steven N. Meyers
*Assistant Examiner*—Thomas P. Hilliard
*Attorney, Agent, or Firm*—Sughrue, Mion, Zinn, Macpeak & Seas

[57] ABSTRACT

With hinge lid packs having a pack part 10 and a lid 11 hinged thereon, especially when they are equipped with round edges, it is difficult to ensure that the lid 11 precisely remains in the proper closing position. In order to guarantee an accurate closing position, a closing pressure is applied to the lid which is a result of frictional resistance or interlocking of a collar 23 in the lid 11. Collar 23 and lid 11 are interlocked by pushing webs 42, which define a recess 29 of the collar 23, into lateral openings 43 of an inner lid flap 39 so that the webs 42 move into a wedged position.

4 Claims, 4 Drawing Sheets

HINGE LID PACK, ESPECIALLY FOR CIGARETTES, WITH STRUCTURAL LOCKING DEVICE

BACKGROUND OF THE INVENTION

The invention relates to a hinge lid pack, especially for cigarettes, having a pack part and a lid hinged on a rear wall thereof, with a collar including a collar front wall and collar side walls arranged in the pack part and projecting therefrom, the portion of said collar projecting from the pack part (upper collar portion) being surrounded by the lid in closed position.

Such hinge lid packs are used worldwide as cigarette packs. The structures of this type of packs are essentially the same.

Recently, packs of this type have appeared on the market which have rounded or polygonal or bevelled upright longitudinal edge With these types of packs, especially with those having "round edges", there occur difficulties when the pack is in closed position. The problem is to ensure on the one hand an easy opening and closing of the pack by means of pivoting the lid, and on the other hand an accurate closing position of the lid. With a lid front wall and (narrow) lid side walls, the lid surrounds respective parts of the collar portion which projects from the pack part, namely a collar front wall and collar side walls. It is desirable that the lid essentially positively abuts a pack front wall or pack side walls. Especially with the above-described embodiments of hinge lid packs, this accurate closing position of the lid is quite often not guaranteed.

SUMMARY OF THE INVENTION

Setting out from this problem, the invention is based on the object to further develop and improve a hinge lid pack of the afore-described type, such that the lid always resumes a correct closing position without forming larger steps or gaps.

In order to attain this object, the hinge lid pack as taught by the invention is characterized in that in closed position, the upper collar portion is positively and/or non-positively held in releasable engagement with a flap arranged on the inside of the lid.

Consequently the basic idea of the invention is to provide a "lock", which takes effect when the lid is moved into closed position, so that said lid is fixed in the closing position by additional holding force. This holding force, however, is so small that it is not noticed when the pack is opened.

Preferably, a portion of the collar front wall, especially at least a web limiting a recess in the front collar wall, positively and/or non-positively engages a flap (inner lid flap) arranged on the inside of the lid front wall when the lid is moved into closed position. The temporary connection between this part of the collar front wall and the inner lid flap is preferably non-positive, such that the lid or lid front wall is connected with its inner lid flap to the collar front wall under increased friction.

For the purpose of the improvement, the inner lid flap is enlarged, so that it substantially extends across the full height of the collar front wall. Lateral notches or openings are arranged on preferably both flap edges (side edges) which extend vertically in the closing position. The upright webs of the collar front wall enter into these openings in the closing position, such that the portions of the inner lid flap located on both sides of the indents or notches abut different sides of the collar front wall and therewith effect the non-positive engagement with increased friction.

As a result of the design of the collar front wall and the inner lid flap, the portions automatically engage one another in a locking manner when the lid is moved into closed position. When the lid is opened, the connection is released without any extra expenditure of force.

The described engagement of portions of the lid with portions of the collar ensures an accurate closing position of the pack, even with those pack types having insufficient closing qualities of the lid, i.e. especially with round edge packs.

Further features of the invention relate to the design of the lid (inner lid flap) and the collar.

A preferred embodiment of the invention is described below in more detail with reference to the drawings, in which:

DESCRIPTION OF A PREFERRED EMBODIMENT

Figure 1:
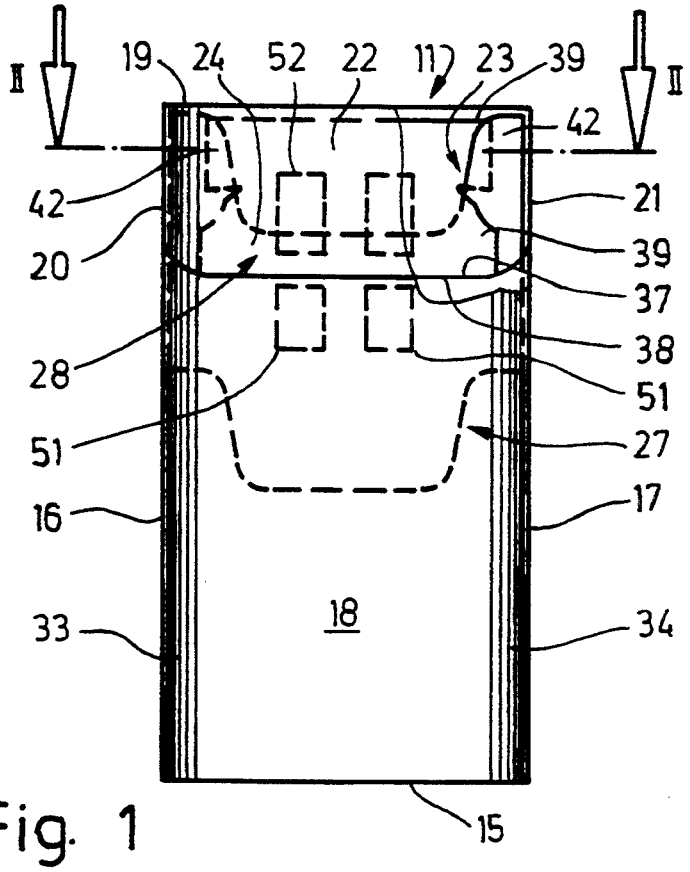
FIG. 1 is a front view of a hinge lid pack, namely a "round edge" pack, in closed position.
Figure 2:
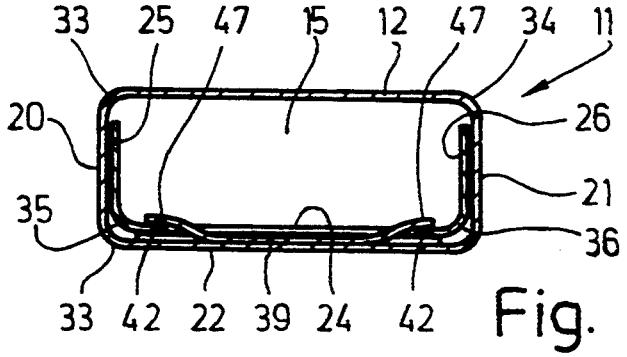
FIG. 2 shows a horizontal section taken along the line II—II of FIG. 1.
Figure 3:
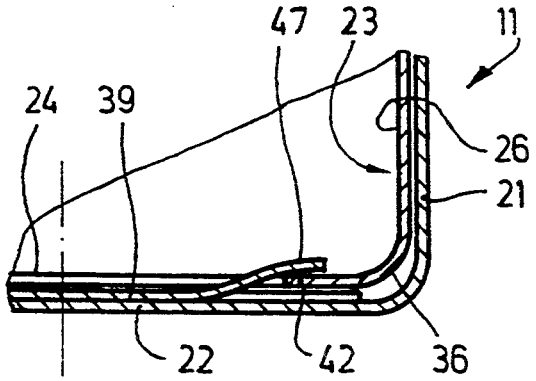
FIG. 3 shows a corner section of the representation of FIG. 2 on an enlarged scale.

The embodiment shown in the drawings relates to a hinge lid pack for accommodating a cigarette group (50) which is usually enwrapped in an inner blank made of tin foil or the like.

The hinge lid pack consists of a pack part 10 and a lid 11. The latter is pivotally connected to the pack part 10. For this purpose, a lid rear wall 12 is connected to a pack rear wall 14 via a hinge 13.

The pack part 10 further consists of a bottom wall 15, pack side walls 16, 17 and a pack front wall 18.

In analogy, the lid 11 consists of an end wall 19, lid side walls 20, 21 and a lid front wall 22.

A collar 23 is inserted into the pack part 10. This collar 23 consists of a collar front wall 24 and transversely directed collar side walls 25, 26. With a lower collar portion 27, the collar sits within the pack part 10. The coller front wall 24 is connected to the inside of the pack front wall 18, especially by means of adhesive bonding. In the present embodiment, two rectangular glue spots 51 are provided for this purpose. The collar side walls 25, 26 abut the insides of the pack side walls 16, 17.

An upper collar portion 28 of the collar 23 projects from the pack part 10. This upper collar portion 28 is surrounded by the lid 11 when the pack is in closed position. In this position, the respective portion of the collar front wall 24 abuts the inside of the lid front wall 22. The collar side walls 25, 26 abut the lid side walls 20, 21.

In the region of the collar front wall 24, the collar 23 is designed in a special way, namely with a recess 29. This recess 29 is laterally limited by inclined side edges 30 diverging towards the upper edge. At the open side of the recess 29, these side edges 30, in a curve 31, merge into a transversely directed upper edge of the collar.

In the present embodiment, the hinge lid pack as described is formed as a "round edge" pack. Upright longitudinal edges 33, 34 of the hinge lid pack are curved, thus forming "rounded" edges, the radius of these curvatures approximately corresponding to the radius of a cigarette.

The rounded longitudinal edges 33, 34 extend in the region of the pack part 10 as well as in the region of the lid 11. Correspondingly, collar edges 35, 36 are rounded off as well.

In closed position of the pack, a transversely directed closing edge 37 of the lid 11 abuts a counter edge 38 of the pack part 10. This closing position shall be secured without rendering the opening of the pack more difficult. For this purpose, the collar 23 is in closing position releasably anchored within the lid 11. For this reason, the collar 23 is in closing position interlocked with a flap inside of the lid, such that there is an increased frictional resistance which prevents the lid 11 from shifting out of its accurate position when the pack is closed.

Figure 4:
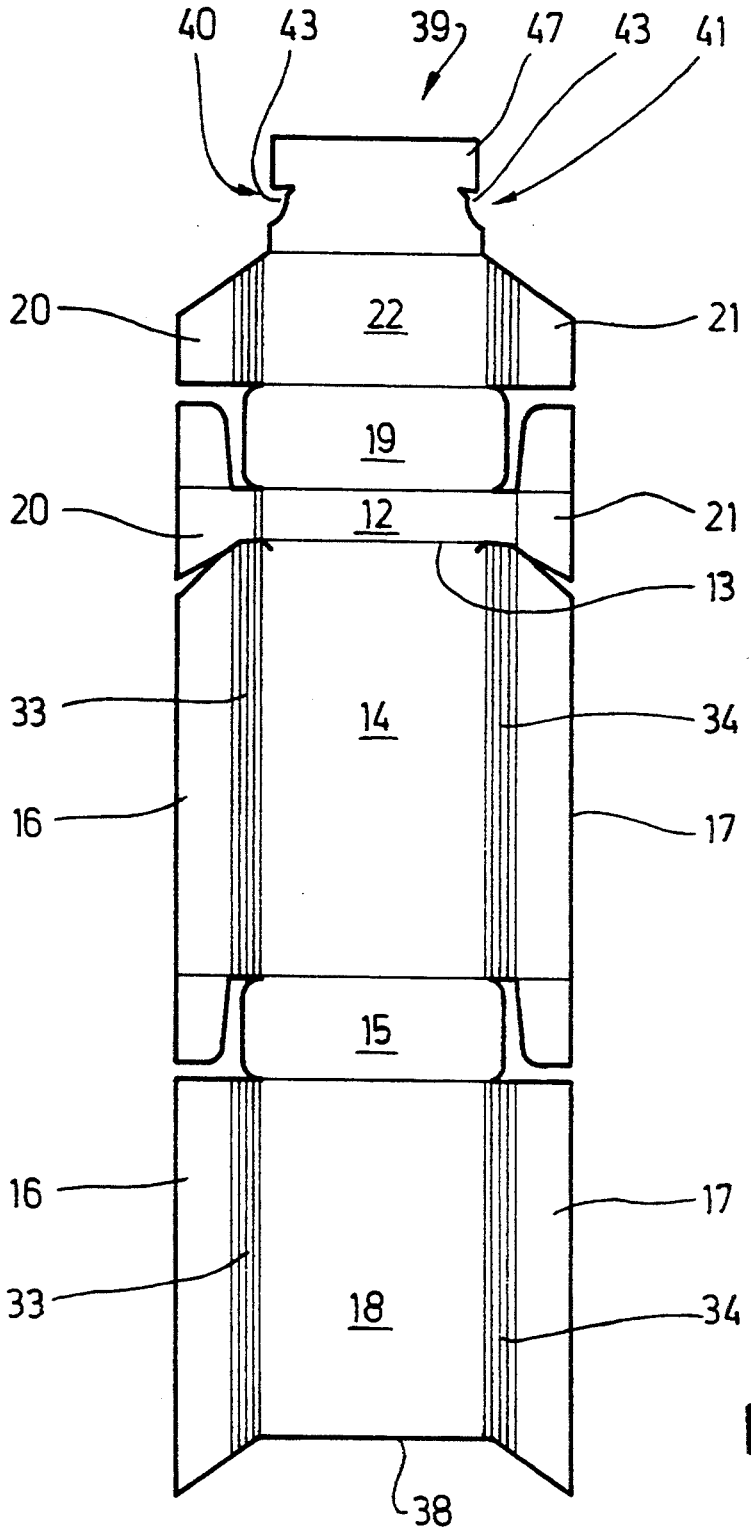
FIG. 4 shows a spread-out blank for a pack as shown in FIG. 1.
Figure 5:
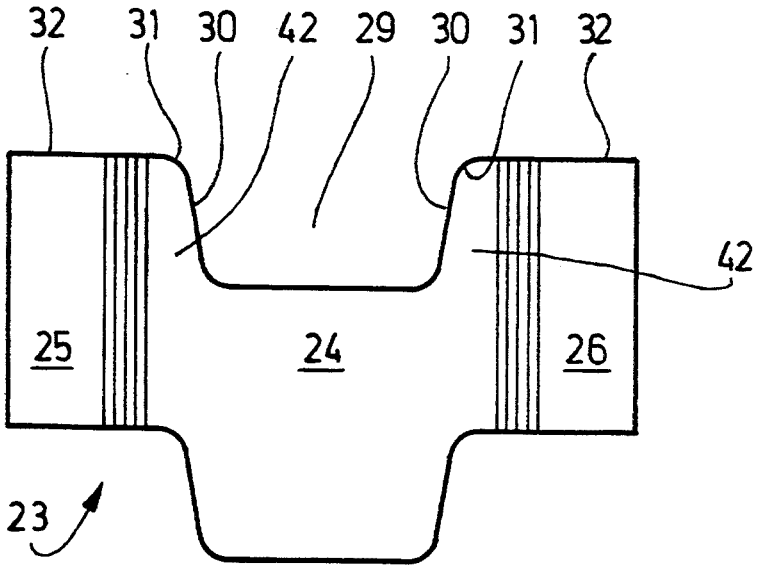
FIG. 5 shows a spread-out blank for a collar on an enlarged scale.
Figure 6:
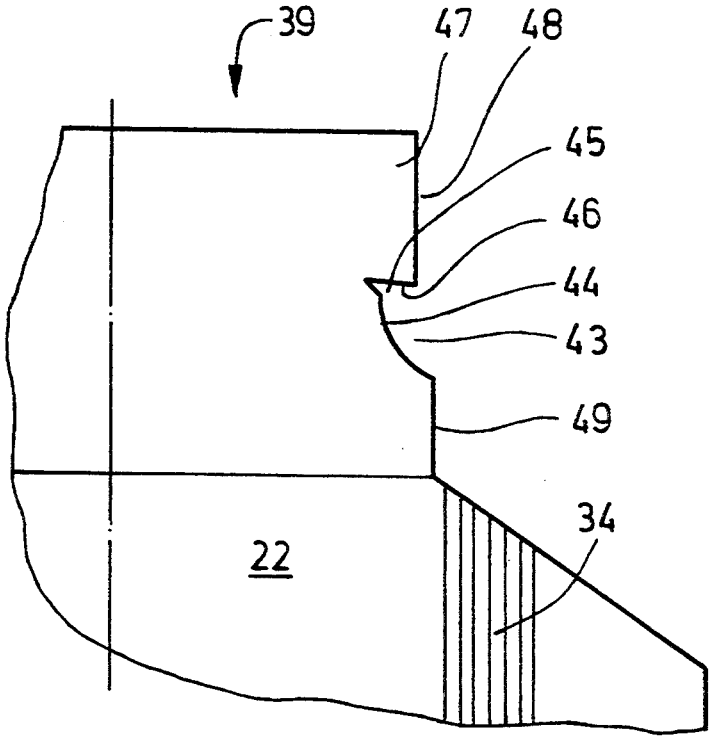
FIG. 6 shows a detail section of the blank as shown in in FIG. 4 in the region of an inner lid flap, on a detail very enlarged scale.
Figure 8:
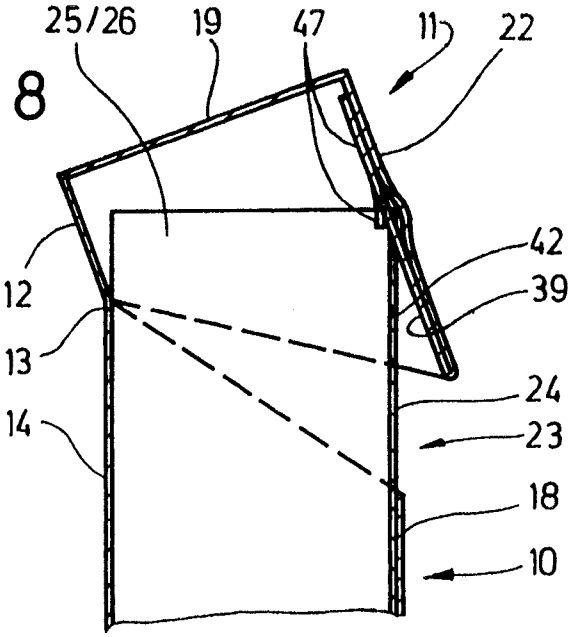
FIG. 8 shows a vertical section taken a long the line VIII—VIII of FIG. 7 on an enlarged scale.

In the present embodiment, an inner lid flap 39 is designed in a special way, such that it is part of the blank for the pack (FIG. 4) and adjoins the lid front wall 22. In the completed pack, the inner lid flap 39 is folded against the inside of the lid front wall 22 and is adhesively connected therewith. In the shown embodiment, two rectangular glueing sections 52 are provided for fixing the inner lid flap 39. These gluing sections 52 are arranged such that lateral portions of the inner lid flap 39 are kept adhesive free.

In the present case, the dimension of the inner lid flap 39 in the longitudinal direction of the blank (FIG. 4) nearly corresponds to the height of the lid front wall 22. Side edges 40 and 41 of the inner lid flap 39 are designed such that in closed position, parts of the collar 23 are fixed in this place, namely lateral upright webs 42 for limiting the recess 29.

For this purpose, the side edges 40, 41 of the inner lid flap 39 are provided with recesses or notches. In the present embodiment, an opening 43 being open towards the edge is provided. This opening 43 is limited by a curved guiding edge 44 which is merging into a slit-like acute-angled extension 45 of the opening 43. The extension 45 is limited by a transverse edge 46.

The web 42 of the collar front wall 24 enters into this opening 43 when the lid 11 is moved into closed position. As a result of the dimensions of the lid 11 in relation to the collar 23, the latter slides with the upper edge 32 and the curve 31 of the webs 42 along the inside of the lid front wall 22. In this process, the upper rounded ends of the webs 42 abut the lid front wall 22 or inner lid tab 39 with a certain pressure. As the pack is closed further, the webs 42, with the curve 31, move into the region of the opening 43. Since the inner lid flaps 39 are not connected to the lid front wall 22 in this area, the ends of the webs 42 enter underneath the transverse edge 46 and therewith under a holding tab 47 limited by this edge 46. When the pack is completely closed, the inclined side edge 30 of the webs 42 is located within the slit-like extension 45 of the opening 43 (FIG. 1). A portion of the webs 42 now extends underneath the holding tab 47, i.e. between said tab 47 and the lid front wall 22. The collar 23, that is to say its webs 42 are thus moved into a wedged position, namely between the holding tab 47 and the lid front wall 22. Beyond the region of the holding tab 47, the collar front wall 24 abuts the inside of the inner lid flap 39.

In closed position, the wedging effect, that is to say the increased friction applied to the collar 23, fixes the closing position of the lid 11. When the pack is opened, the inner lid flap 39 is pulled out of the wedged position. The opening process is not different to that of ordinary hinge lid packs.

Figure 9:
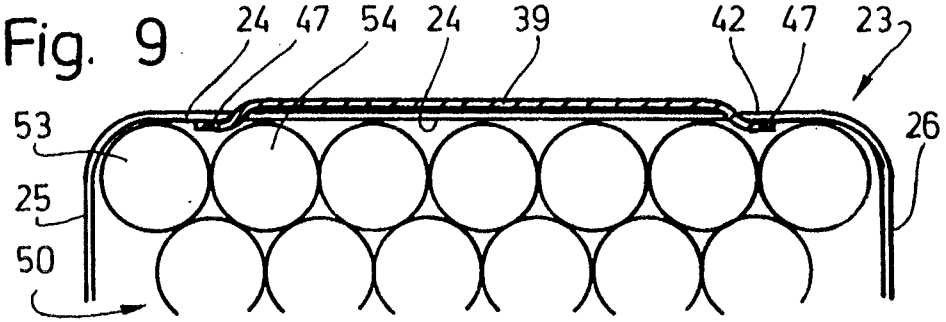
FIG. 9 shows a horizontal section approximately taken along the line II—II of FIG. 1, but without showing details of the lid, on a very enlarged scale.
Figure 7:
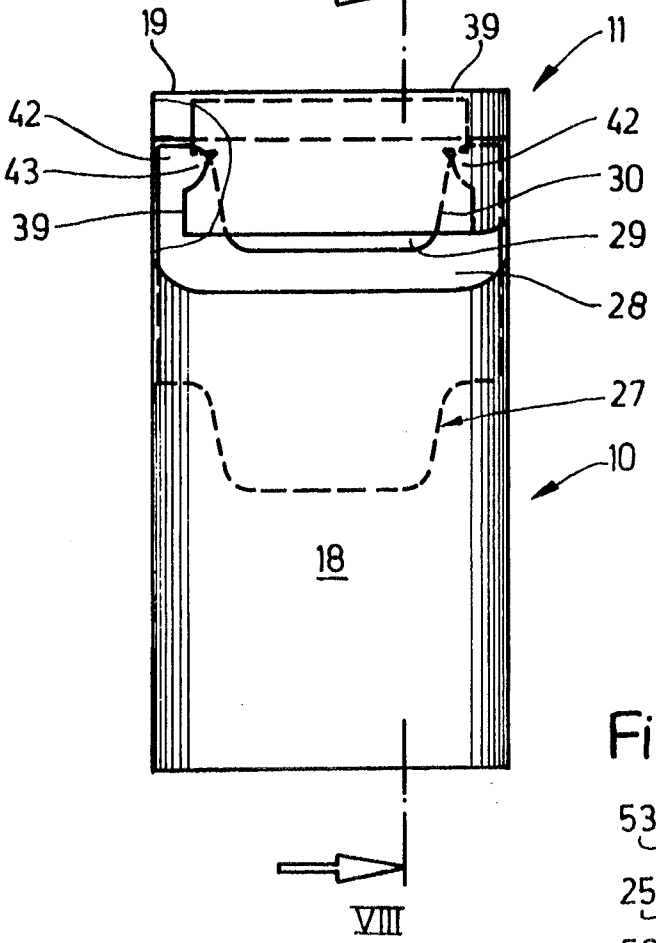
FIG. 7 shows a representation of the hinge lid pack in analogy to FIG. 1 at the stage of closing the lid.

The above-described wedged or frictional connections between collar 23 and inner lid flap 39 are arranged such that cigarettes are not affected therewith, not even when the upper part of the cigarettes is exposed after the pack has been put into use. For this purpose, a lateral limiting edge 48 of the holding tab 47 is set back relative to a limiting edge 49 in a region of the inner lid flap 39 facing towards the lid front wall 22. This means that in the region of the holding tab 47, the inner lid flap 39 is formed with a reduced width. The holding tab 47 is arranged such that it does not centrally abut a cigarette but is located offset thereto. Thus, the web 42, which is also located in a position offset to a cigarette, can be pushed underneath the holding tab 47 without affecting the peripheral surfaces of the cigarettes. This relative position is shown in FIG. 9. The frictional or wedged connection between collar 23 and inner lid flap 39 is in this embodiment located between a corner cigarette 53 and an adjacent cigarette 54. In this area, there is a sufficient gap between the periphery of the cigarettes 53, 54 and the path of motion of the holding tab 47 so that the holding tab 47 can be freely pushed into wedged position without touching the cigarettes 53, 54.

What is claimed is:

1. A hinge lid pack for cigarettes, comprising:

a pack part (10) and a lid (11) having a front wall, said lid being hinged on a rear wall (14) of said pack;

a collar (23), having a collar front wall (24) and collar side walls (25, 26), disposed in said pack part (10) and having an upper portion projecting therefrom;

front webs (42) forming a recess (29) in said upper portion of said collar front wall (24);

an inner lid flap (39) on the inside of said lid (11) and folded to be positively engaged by a portion of said collar front wall (24) in the closed position of said pack; and said inner lid flap (39) having side edges (40, 41) provided with openings (43) into which said webs (42) of the collar front wall (24) are pushable in such a manner that a portion of each front web (42) is moved into a region between said inner lip flap (39) and said lid front wall (22).

2. The hinge lid pack as claimed in claim 1, wherein each of said webs (42) is provided with a curve (31) located at an upper free end of the web, and wherein each web has an inclined side edge (30) which adjoins said curve (31).

3. The hinge lid pack as claimed in claim 1 or 2, wherein said inner lid flap (39) comprises a pair of holding tabs (47), each holding tab (47) adjoining one of the openings (43) of the inner lid flap (39) and coveting a portion of one of the webs (42) of said collar front wall (24) in the closed position of the pack, each holding tab (47) being defined in a region of an opening (43) by a transverse edge (46) abutting each web (42).

4. The hinge lid pack as claimed in claim 3, wherein said inner lid flap (39) has a lesser width at said holding tabs (47) than at the remainder of said inner lid flap (39), and wherein the positive engagement of collar (23) and inner lid flap (39) occurs in a pack region defined by an inherent gap between two adjacent cigarettes in a full pack of cigarettes.

* * * * *